United States Patent [19]

Mazzucco

[11] Patent Number: 4,581,684

[45] Date of Patent: Apr. 8, 1986

[54] PORTABLE READING LAMP

[75] Inventor: Daniel Mazzucco, Annemasse, France

[73] Assignee: Terson S.a.r.l., Annemasse, France

[21] Appl. No.: 780,267

[22] Filed: Sep. 26, 1985

[30] Foreign Application Priority Data

Oct. 19, 1984 [FR] France ..... 84 16056

[51] Int. Cl.[4] ..... F21V 33/00

[52] U.S. Cl. ..... 362/98; 362/199; 362/183; 362/188; 362/287

[58] Field of Search ..... 362/98, 199, 183, 188, 362/287, 99

[56] References Cited

U.S. PATENT DOCUMENTS 2,524,461 10/1950 McDowell ..... 362/98
2,561,744 7/1951 Langdon et al. ..... 362/98
3,479,499 11/1969 Dahl ..... 362/199

FOREIGN PATENT DOCUMENTS 677767 7/1939 Fed. Rep. of Germany ..... 362/99
1109788 6/1961 Fed. Rep. of Germany ..... 362/98

*Primary Examiner*—E. Rollins Cross
*Attorney, Agent, or Firm*—Young & Thompson

[57] ABSTRACT

Portable lamp comprising a foot (16) provided with fixing means (23, 24), an arm (17, 18) and lamp-shade (19) provided with a socket as well as with feeding means with electrical current of low voltage for said socket. The arm (17, 18) is hinged at its upper end on the lamp-shade (19) and at its lower end on the foot (16). The lower part (17) of the arm is made of one piece of moulding with the foot (16) and this lower part and this foot comprise friction means (20, 21) entering in contact during the pivotement of the arm (17, 18) on the foot (16) permitting to fix these elements in a desired angular position. The lamp-shade (19) is made out of one piece of moulding with the upper part (18) of the arm (17, 18) and the internal faces of the rear parts (28) of the lamp-shade (19) co-operate with the lateral faces (26) of the upper part (18) of the arm to maintain by friction the chosen angular position of the lamp-shade (19) on the arm (17, 18).

8 Claims, 8 Drawing Figures

FIG. 1
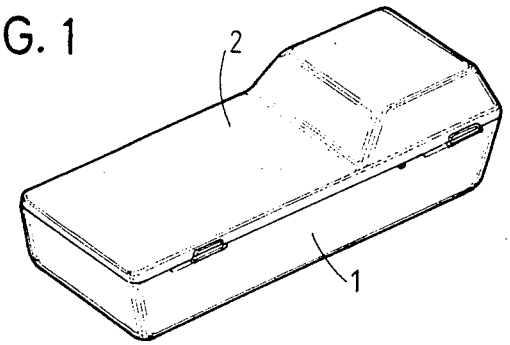
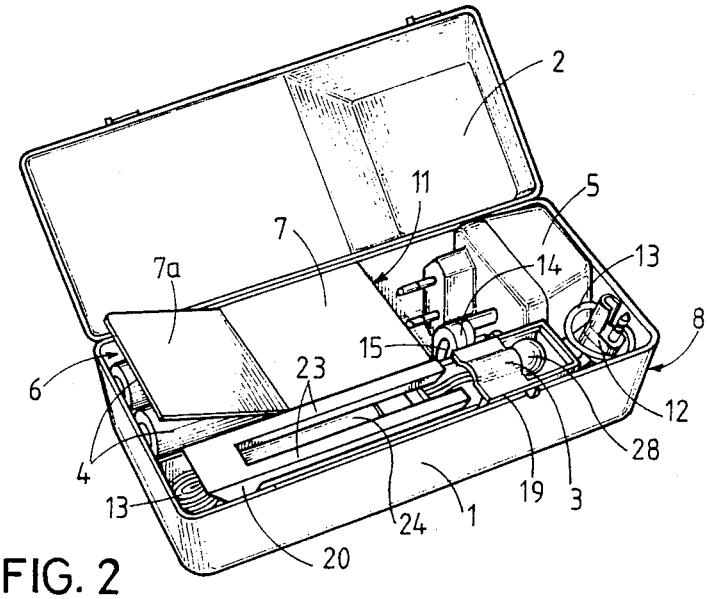
FIG. 2
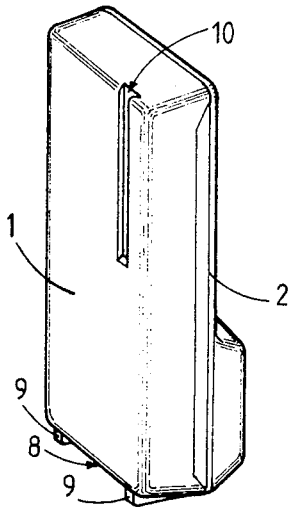
FIG. 3

PORTABLE READING LAMP

The present invention has for its object a portable reading lamp which can be for example fastened easily on a book or a docket and which is sufficiently light not to incommodate the reader. Further, this lamp is adjustable along several directions so that the reader is able to position it in function of the manner in which he holds the book to have always a good lightening. Finally, this lamp has to be independent and thus have to comprise an own feeding source in order not to be dependent on an electric socket. This lamp must further be of low encumbrement and foldable so that it can be stored in a low volume to enable to take it in a luggage.

There are portable reading lamps which can be for example fastened at the head of a bed or on a book by means of a plier. However, these models are generally heavy and cumbersome.

The French published patent application No. 2.541.754 shows a portable lamp which is light and which presents several degrees of freedom from its adjustment but having the inconvenient of not being able to be folded in a small volume in non-service position and above all which does not permit to adjust the distance between the bulb and the ligntened reading surface.

The present invention has therefore for its object a portable reading lamp which tends to obviate to the precited drawbacks and which distinguishes itself by the fact that it comprises a foot presenting fast fixing means onto an object; a telecospic arm, the lower part of which is hinged along an axis perpendicular to the longitudinal axis of the foot on the said foot, and the upper part of which slides on this lower part, and a lamp-shade hinged on the free end of the upper part of the telescopic arm along an axis which is parallel to the pivotement axis of the lower part of the arm onto the foot, this lamp-shade housing a socket intended to receive a bulb, connected to a feeding wire.

The attached drawing shows schematically and by way of example one embodiment of the portable reading lamp.

FIG. 1 shows the lamp housed in its closed box for the journey.

FIG. 2 shows the lamp housed in its box, this one being opened.

FIG. 3 shows the box in vertical position serving as support for the lamp.

Figure 4:
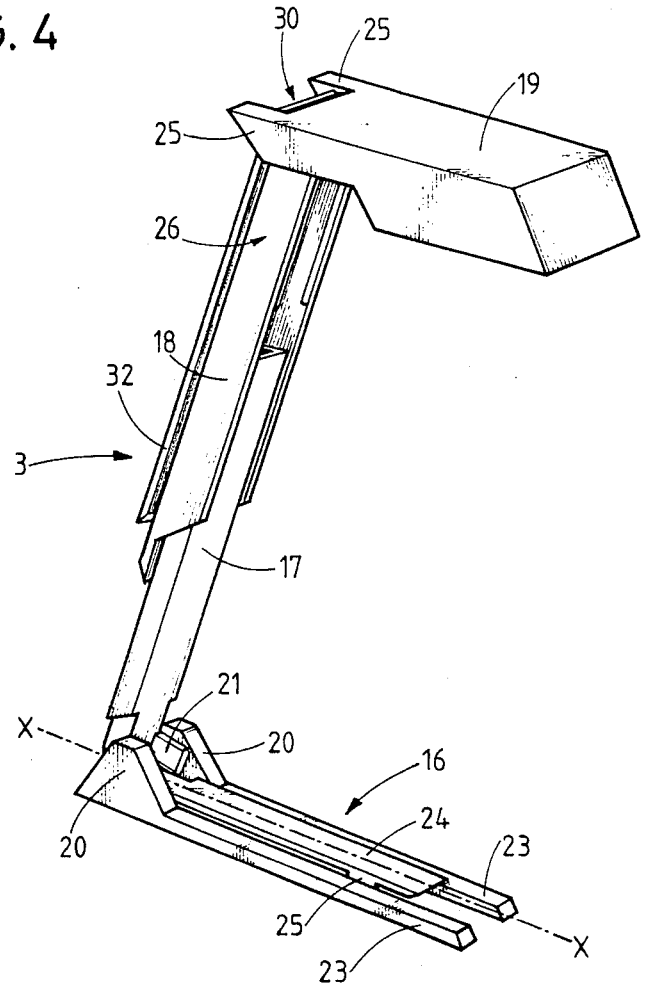
FIG. 4 shows the lamp in service position.

In the embodiment shown the portable reading lamp comprises a box 1 provided with a cover having hinges in which are located, for their storage and transport, the lamp 3 itself, batteries or feeding accumulators 4, as well as an adaptator 5 permitting either the direct feeding of the low voltage lamp through a electric distribution network or the recharging of the accumulators. The batteries or accumulators 4 are located in a compartment 6 of the box 1, 2 which is closed by a removable cover 7 one part of which 7*a* is foldable to enable to change the batteries 4 without completely loosening this cover 7.

The lateral walls of the box 1 are slightly conical to enable their unmoulding and the end face 8 of this box 1 comprises rips 9 having increasing thickness constituting feets permitting to lay the box on an horizontal surface in vertical position as shown at FIG. 3.

This box 1, 2 comprises further a groove 10 presenting in transversal crosssection the shape of a dovetail, provided in its bottom and extending parallely to the great sides of this bottom. As one will see later on this groove 10 permits the fixation of the lamp on the box which then forms a stand or support for it.

Finally, the free lace 11 of the compartment 6 receiving the batteries or accumulators 4 comprise a plug or connector (not shown) connected in a known way to the said batteries, intended to co-operate either with a socket 12 connected to the end of a feeding wire 13 of the lamp 3 or with a socket 14 connected to the end of the wire 15 coming out from the adaptator 5.

The lamp 3 itself is constituted by a foot 16 provided with fixing means on a support, a telescopic arm 17, 18 and lamp-shade 19.

The foot 16 of the lamp is made out of one piece of manufacture, by moulding, with a lower part 17 of the telescopic arm of the lamp. A plastic hinge 22, constituted by a weakening of the material, extending perpendicularly to the longitudinal axis x—x of the foot 16 permits a pivotement of the arm 17, 18 with respect to the foot from a position for which the lower part 17 of the arm is located in the extension of the foot up to a position for which the lower part of the arm 17 is folded against the upper face of the foot.

This foot comprises at its rear end, near the hinge 22 connecting it to the lower part 17 of the arm, two pyramidal prongs 20 the outside faces of which are each located in one of the lateral faces of the foot and the internal faces of which co-operate with the outside faces of two pins 21 of the lower part 17 of the arm. These pins 21 comprise wedge faces 21*a* to guide their entrance into contact with the internal faces of the prongs 20. The friction between these pins 21 and the internal faces of the prongs 20 is sufficient to permit to fix the arm 17, 18 in an angular position chosen by the reader.

Passages 24*a* provided in the foot 16 give passage to the pins 21 to enable the complete folding of the arm 17, 18 against the foot 16.

The foot 16 comprises further fixing means on a support such as the covering page of a book for example. These fixing means are constituted in this embodiment by two lower blades 23, located in a same plan but separated the one from the other, inserted each by their rear end in one of the prongs 20. These fixing means comprise further an upper blade 24 the rear end of which is fast with the two prongs 20. This upper blade 24 is slightly wider than the free space between the lower blades 23 and covers it. The lower face of this upper blade 24 is located in a plan approximatively parallel to the plan containing the upper faces of the lower blades 23, an abutment 25 fast with the upper blade 24 entering normally in contact with the upper faces of the lower blades 23. Thanks to the own resiliency of the blade 24 and/or the blades 23 one realises a plier or a resilient fork which can be slept onto the cover of a book and pinch it sufficiently strong to maintain the lamp in the position chosen by the reader.

The lower part 17 of the arm 17, 18 of the lamp presents mainly a tubular shape having a crosssection which is square or rectangular the outside dimensions of which correspond to the inside dimensions of the upper part 18 of this arm so as to be able to slide with friction in it. Therefore, the length of the arm 17, 18 can be modified at will by the reader, the friction between the two parts 17, 18 being sufficient to ensure to maintain these parts in the position chosen by the user.

The upper part 18 of the telescopic arm is made out of one piece of moulding with the lamp-shade 19 and these parts are connected by a plastic hinge 30. This plastic hinge extends parallely to the plastic hinge 22. The internal faces 31 of the rear extensions 25 rest against the lateral faces 26 of the upper part 18 of the telescopic arm to enable to fix the relative position of the lamp-shade on the arm as desired by the user. Inclined plans 27 at the end of each rear extensions 25 ensure a smooth and progressive engagement between these parts and the upper part 18 of the arm.

A socket (not shown), is mounted in the lamp-shade to receive a bulb fed with electric current at low voltage by the wire 13.

When the lamp is not used it is stored in its box, the telescopic arm 17, 18 is shortened at the maximum, the foot 16 is folded against the lower part 17 of the arm and the lamp-shade 19 is extended in the prolongation in the upper part 18 of the arm.

The back of the upper part 18 of the arm has a male formation 32 having a transversal crosssection with a dovetail shape intended to co-oporate with a groove 10 of the box.

So, when the box 1 is placed in vertical position (FIG. 3) the lamp can be fixed to it by the introduction of the formation 32 in the groove 10 so as to realize a portable table lamp. In this position, the foot 16 is folded against the lower part 17 of the arm. In a variant the female formation can be constituted by an aperture provided in the wall of the box 1 and the male formation by a lug carried by the back of the upper part of the arm.

Figure 5:
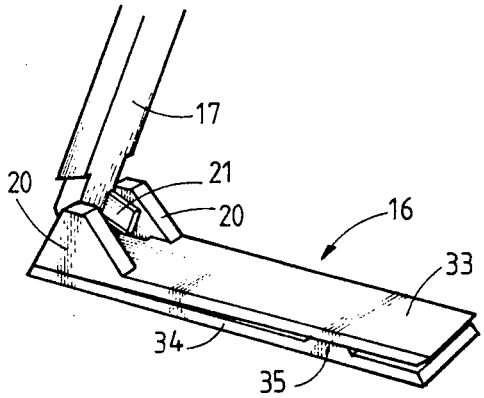
FIG. 5 shows a variant of the foot of the lamp.
Figure 6:
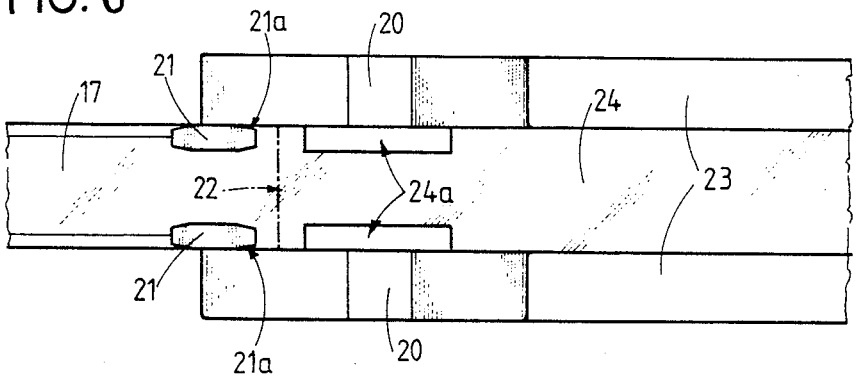
FIG. 6 is a partial view at greater scale from above of the foot and of the lower part of the arm of the lamp.
Figure 7:
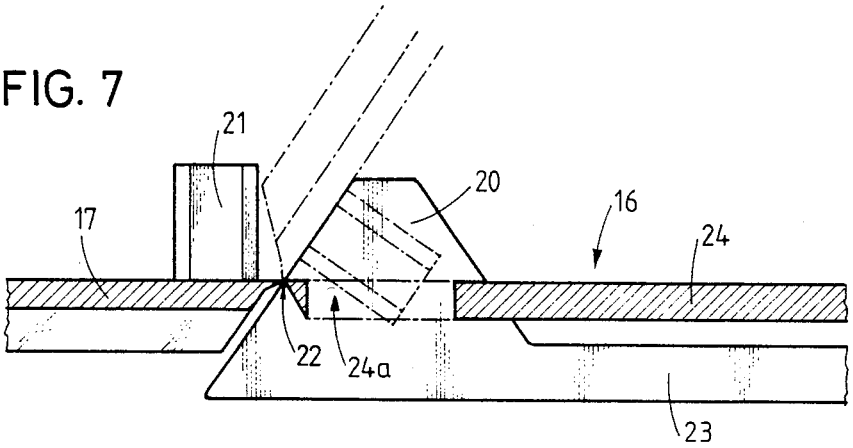
FIG. 7 is a partial crosssection at greater scale of the foot and of the lower part of the arm of the lamp.
Figure 8:
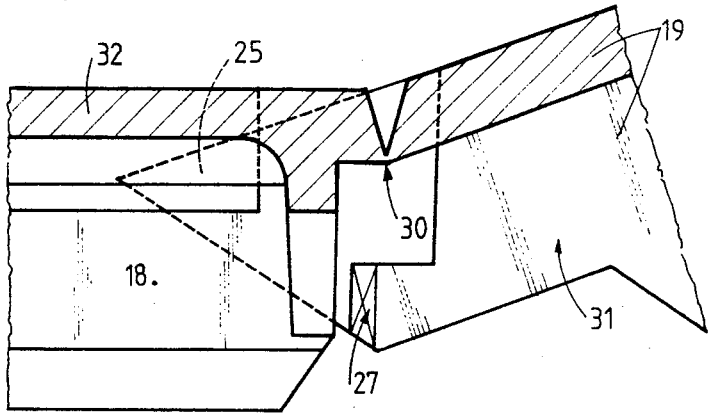
FIG. 8 is a partial view, in crosssection and at greater scale of the lamp-shade and of the upper part of the arm of the lamp.

The FIG. 5 shows a variant of the foot 16 which comprises fixing means constituted by a plier formed of an upper plate 33 fast with the prongs 20 and a lower plate 34 connected to the prongs 20 by a resilient member tending to apply it to the upper plate 33 against which it rests normally by means of an abutment 35.

The interest of such a portable reading lamp is that it is very light and compact, it can be adjusted at will in different positons by the reader and particularly the distance of the lamp-shade towards the surface to be lightened can be adjusted by means of the telescopic arm so that the lightening of this surface in function of its dimension be the best possible.

Futhermore, this lamp can be fed by batteries of by the network and when it is not used it can be stored as well as the adaptator in a box housing the batteries or the accumulators. Finally, as it can be fixed on the box which can be placed vertically the lamp can be converted into a table lamp.

I claim:

1. Portable lamp comprising a foot provided with fixing means, an arm and a lamp-shade provided with a socket as well as with feeding means with electrical current of low voltage for said socket; in which the arm is hinged on its upper end to the lamp-shade and at its lower end to the foot, characterized by the fact that the lower part (17) of the arm (18) is made of one piece of moulding with the foot (16) and that this lower part and this foot comprises friction members (21) entering in contact during the pivotement of the arm on the foot permitting to fix these elements in a desired angular position; and by the fact that the lamp-shade (19) is made of one piece of moulding with the upper part (18) of the arm and that internal faces (31) of the rear parts (25) of the lamp-shade co-oporate with the lateral faces (26) of the upper part of the arm to maintain by friction the chosen angular position of the lamp-shade onto the arm, and by the fact that the arm is telescopic and formed of two parts, the lower part of the arm (17) sliding with friction into its upper part (18), this friction maintaining the arm at the length chosen.

2. Lamp according to claim 1, characterized by the fact that the friction means of the foot are formed by the internal lateral faces of prings (20) whereas the friction members (21) of the lower part of the arm are constituted by the outside faces of pins (21*a*) carried by this lower part.

3. Lamp according to claim 2, characterized by the fact that at least one edge (21*a*) of each pin (21) is slanted.

4. Lamp according to claim 1, characterized by the fact that the fixing means of the foot are constituted by a plier (23, 24).

5. Lamp according to claim 4, characterized by the fact that the plier comprises an upper blade (24) fast with the rear part of the foot and two lower blades (23) also fast with the lower part of the foot, and by the fact that the upper blade and/or the lower blades are resiliently deformable.

6. Lamp according to claim 4, characterized by the fact that the plier comprises an upper plate (35) fast with the rear part of the foot and a lower plate (34) connected to this rear part of foot by a resilient member tending to deplace it towards the upper plate.

7. Lamp according to claim 1, characterized by the fact that it comprises a box (1,2) presenting a compartment receiving batteries or accumulators, a place permitting to store the folded lamp and a place intended to receive an adaptator.

8. Lamp according to claim 7, characterized by the fact that the external face of the bottom of the box comprises a female formation (10) intended to co-operate with a male formation (32) carried by the back of the upper part (18) of the arm of the lamp, the box serving thus as support for the lamp.

* * * * *